United States Patent [19]

Heinen, Jr.

[11] Patent Number: 5,048,149

[45] Date of Patent: Sep. 17, 1991

[54] VAC-BRUSH

[76] Inventor: Leslie A. Heinen, Jr., 4510 Briardale, San Antonio, Tex. 78217

[21] Appl. No.: 372,437

[22] Filed: Jun. 27, 1989

[51] Int. Cl.[5] ..... F04H 3/20

[52] U.S. Cl. ..... 15/328; 15/1.7; 15/415.1

[58] Field of Search ..... 15/1.7, 415 R, 328

[56] References Cited

U.S. PATENT DOCUMENTS

| | | | |
|---|---|---|---|
| 1,970,290 | 8/1934 | Ernzer | 15/1.7 |
| 2,141,811 | 12/1938 | Everson | 15/1.7 |
| 3,039,122 | 6/1962 | Birdsall | 15/1.7 |
| 3,102,289 | 9/1963 | Norris | 15/1.7 |
| 3,961,393 | 6/1976 | Pansini | 15/1.7 |
| 4,402,101 | 9/1983 | van Zyl | 15/1.7 |
| 4,734,954 | 4/1988 | Greskovics et al. | 15/1.7 |

FOREIGN PATENT DOCUMENTS

| | | | |
|---|---|---|---|
| 2023593 | 11/1971 | Fed. Rep. of Germany | 15/1.7 |

*Primary Examiner*—Chris K. Moore

[57] ABSTRACT

The VAC-BRUSH is a multi-functional apparatus used in the cleaning and vacuuming of gunite or marble plaster swimming pools. It can be used as a vacuum alone or in combination with a brush system ahead of the suction line thereby permitting the brushed particles to immediately be drawn into the filtration system and not into suspension.

4 Claims, 3 Drawing Sheets

VAC-BRUSH

SUMMARY OF INVENTION

The VAC-BRUSH is a multi-functional apparatus used in the cleaning and vacuuming of gunite or marble plaster swimming pools. It can be used as a vacuum alone or in combination with a brush system ahead of the suction line thereby permitting the brushed particles to immediately be drawn into the filtration system and not into suspension.

Conventional vacuuming will not always remove all dirt and debris, necessitating the brushing of these areas. This dirt and debris must settle over a period time before it can be vacuumed. The VAC-BRUSH eliminates the brushing and resultant settling time.

DESCRIPTION OF DRAWINGS

Included with this submittal are five figures depicting the concept of this invention. All five figures are full scale (i.e. 1"=1"). A description of each figures follows.

Figure 1:
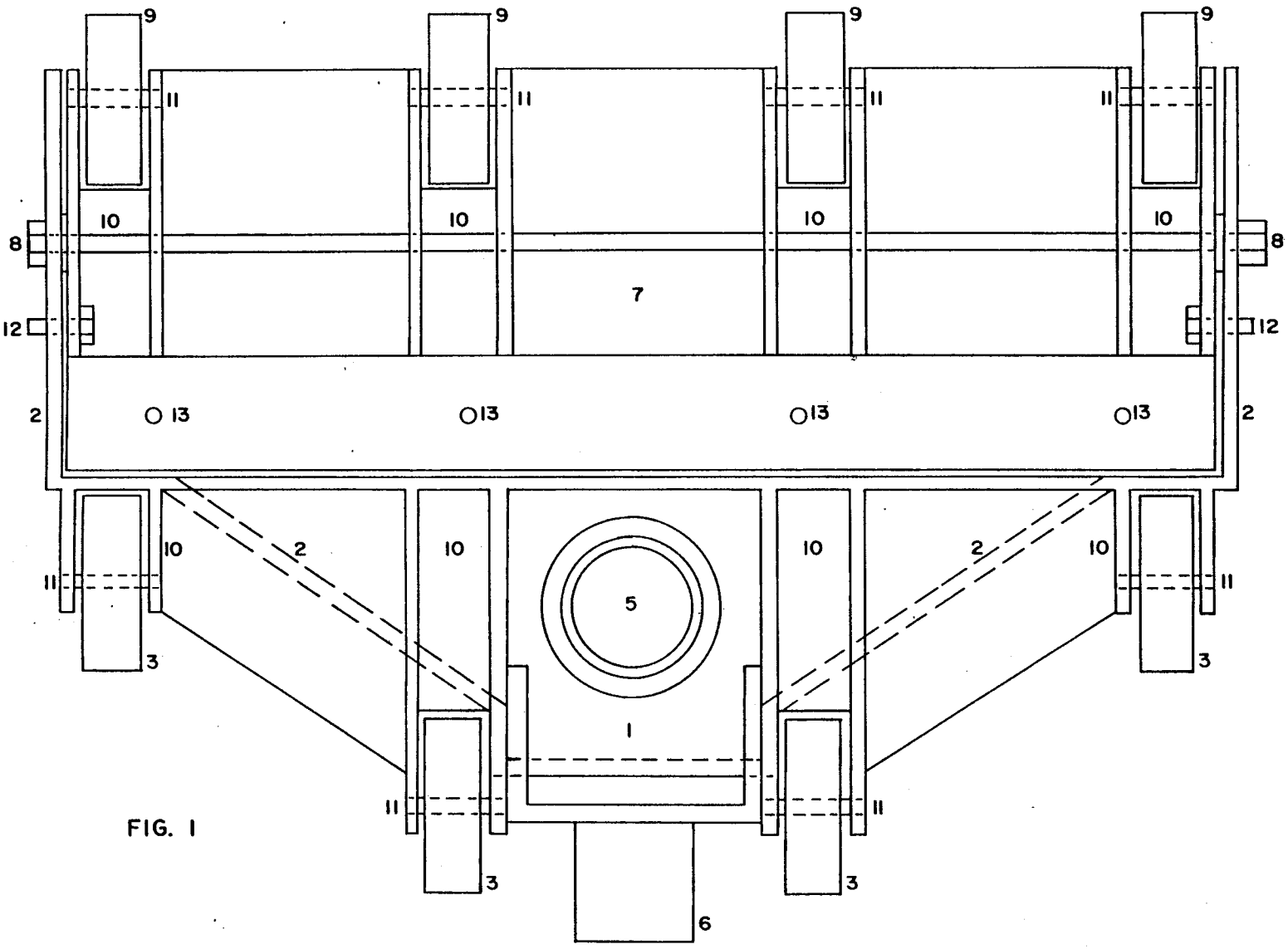
FIG. 1—Top Plan View Normal Operation

This view shows the invention as viewed looking down with the invention in "Normal Operation". The front of the vacuum is to the left, holding the drawing with the top up. The suction stack is shown as three concentric circles with the pole yoke shown attached to the wheel supports directly behind. The four horizontal rectangles to the front and the rear represent the front and rear wheels respectively. The wide vertical rectangle represents the brush and the narrow vertical rectangle between the front wheels and the brush represents the center pivot.

Figure 2:
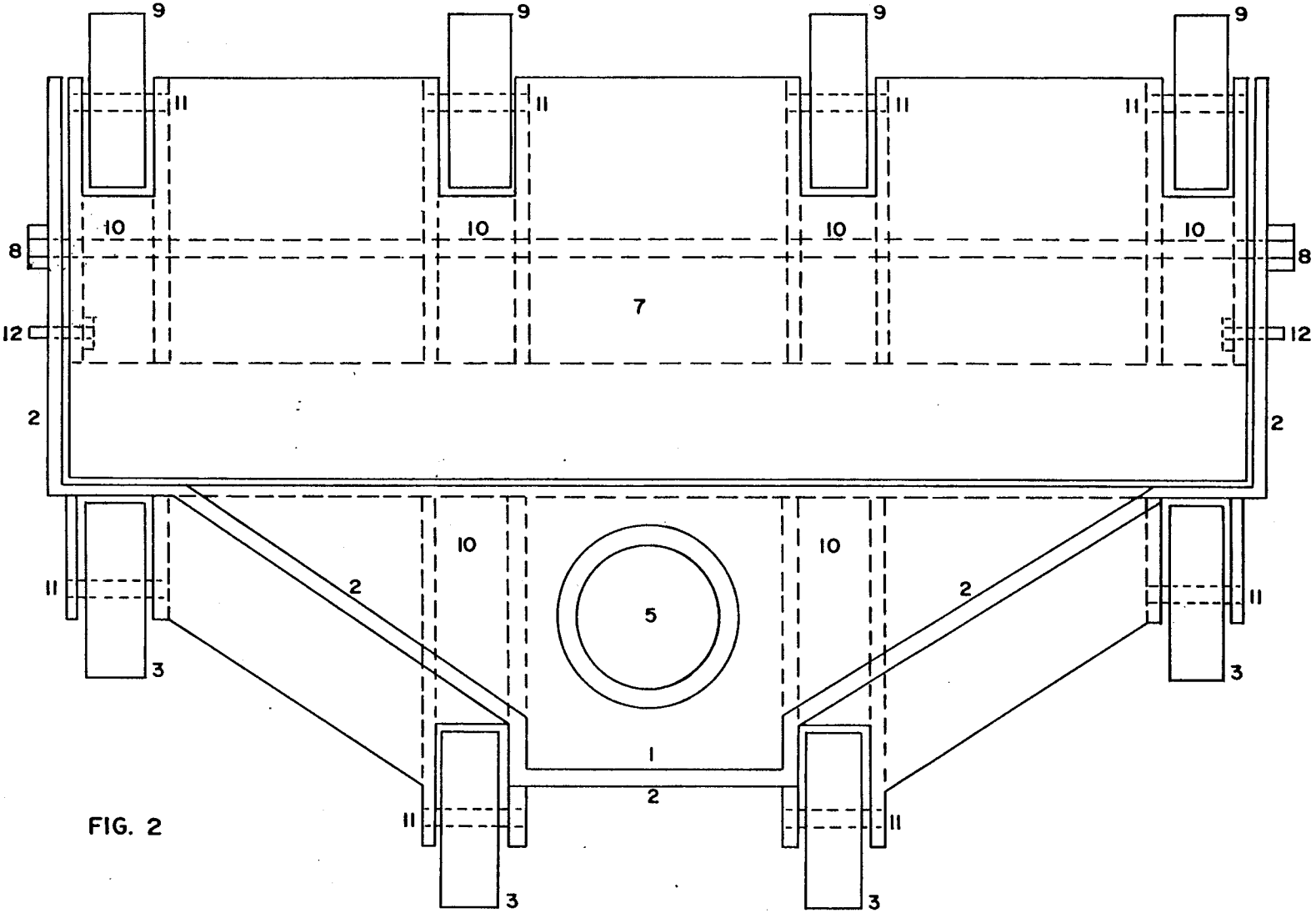

FIG. 2—Bottom Plan View Normal Operation

This view is a bottom plan view oriented exactly as view 1 described above with the features locations and functions identical. The pole yoke has not been seen for clarity.

Figure 5:
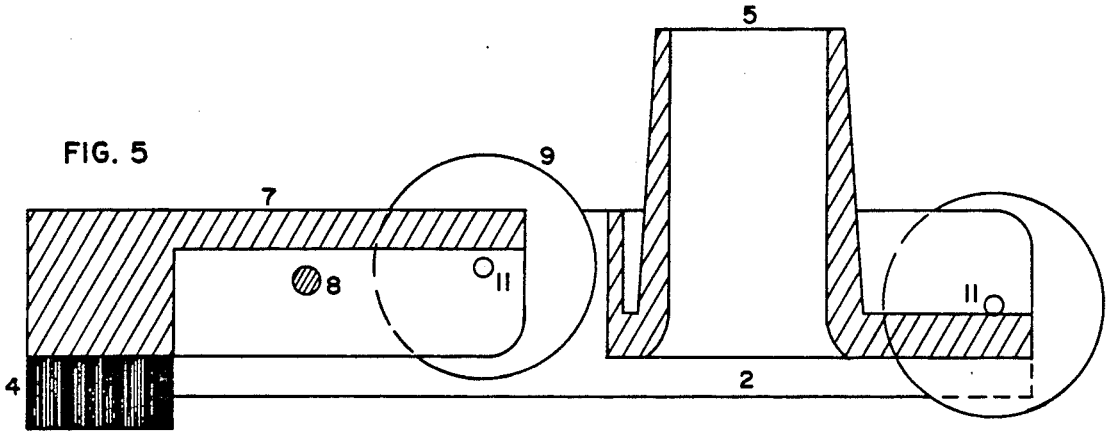
Figure 4:
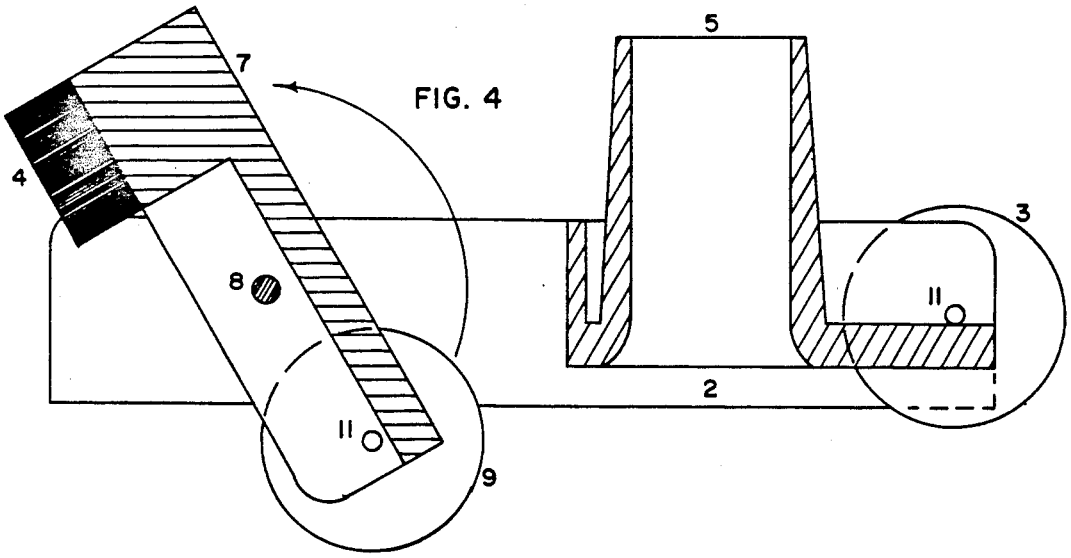
Figure 3:
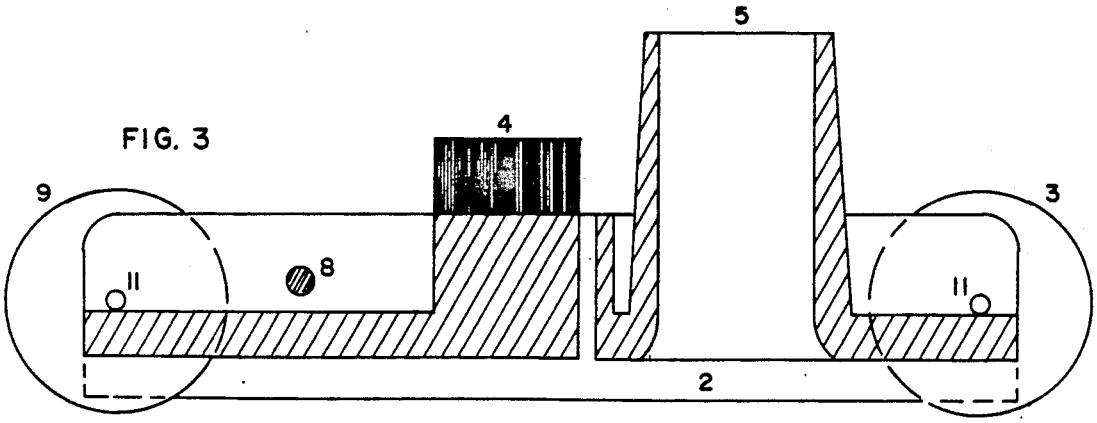

FIGS. 3–5 show three sections all cut through the center of the suction stack with the front to the left, the rear to the right.

FIG. 3 shows the configuration in normal operation with both the front and rear wheels supporting the device.

FIG. 4 shows the pivoting of the wheel/brush support changing to the vac-brush mode rotating around the center pivot.

FIG. 5 shows the device in the vac-brush mode with the brush in contact with the pool bottom and the front wheels located where the brush is located in the normal mode. The suction stack is shown where a industry standard vacuum hose can be attached.

The following is a list and description of the reference marks used on the drawings and in the ensuing DETAILED DESCRIPTION:

| REF. MARK | DESCRIPTION |
|---|---|
| 1 | Horizontal Plate |
| 2 | Turned Down Edges |
| 3 | Rear Wheels |
| 4 | Continuous Brush |
| 5 | Suction Stack |
| 8 | Pole Yoke |
| 7 | Wheel Brush Assembly |
| 8 | Center Pivot |
| 9 | Front Wheels |
| 10 | Wheel Supports |
| 11 | Wheel Axle |

-continued

| REF. MARK | DESCRIPTION |
|---|---|
| 12 | Wheel Brush Wing Nut |
| 13 | Brush Retaining Screw |

Note that the reference marks used in the text are shown as superscripts, thusly[7].

DETAILED DESCRIPTION

Background

The VAC-BRUSH is a multi-functional apparatus used in the cleaning and vacuuming of gunite or marble plaster swimming pools.

Conventional vacuuming will not always remove all dirt and debris, necessitating the brushing of these areas. This dirt and debris must settle over a period time before it can be vacuumed. In extreme pool conditions, the brushing operations can obscure the work effort resulting in only small portions of the pool being worked at a time.

The VAC-BRUSH elminates the brushing and resultant settling time. In extreme pool conditions, the work effort can be continuous in that virtually no dirt, debris or chemical residual becomes suspended in the pool water. It can be used as a vacuum alone or in combination with a brush system ahead of the suction line thereby permitting the brushed particles to immediately be drawn into the filtration system and not into suspension.

Design

The VAC-BRUSH consists of a horizontal plate[1] with turned down edges[2] on the sides and rear. The turned down edges[2] extend to within ⅛ of the pool bottom to maximize the suction from the front. The plate is supported by four wheels in the front[9] and four wheels in the rear[3] (normal operation) or four wheels in the rear[3] and a continuous brush[4] along the front (vac-brush operation). All wheels rotate on wheel axles[11].

Suction is provided through a vertical cylindrical stack[5], located near the rear. An industry standard suction hose is attached to the stack[5] and to the filtration system.

The VAC-BRUSH is propelled manually by use of an industry standard pole attached to a pivotal yoke[6] located just behind the suction stack[5], hinged to the wheel supports[10].

The conversion from normal operation to vac-brush operation is accomplished by removing two wheel brush wing nuts[12] and rotating the wheel/brush assembly[7] 180° about the center pivot[8], locating the brush[4] where the front wheels[9] would be in normal operation and replacing the wheel brush wing nuts[12]. The brush[4] now supports the front of the VAC-BRUSH and can brush ahead of the suction when pushed forward.

The amount of pressure exerted by the brush is a function, in part, of the pool bottom/side slope, the angle of the yoke and the manual pressure exerted. However, in essence, the more manual pressure exerted the more "scrubbing power" is achieved.

With the brush[4] accepting the direct front loading, considerable wear will be realized. For this reason, the brushes can be replaced by removing four brush retaining screws[13], removing and replacing the brush assembly and replacing the four brush retaining screws[13].

The VAC-BRUSH assembly will be constructed using ultra-violet inhibited Poly-Vinyl-Chloride plastic. The wheels will be hard plastic and all hardware including center pivot will be stainless steel or other non-corrosive metal.

I claim:

1. A cleaning device for use as an aid in cleaning hard, smooth surfaces; said cleaning device consisting of:

a two piece horizontal plate supported by front and rear wheels in normal, vacuum only mode, and a continuous width front brush and rear wheels in a combined vacuuming/brushing mode;

said two piece plate consisting of:

a rear plate having a suction stack for attachment to a vacuum hose, a pole yoke for connection to a pole handle, wheels for rear support, and means for pivotal attachment of a front plate;

a front plate having a continuous brush attached to one side for use in the vacuum/brush mode, and front support wheels on the opposite side for use in the vacuum only mode.

2. The cleaning device of claim 1, wherein said means for pivotal connection including a pivot rod, whereby said front plate may be rotated about the pivot rod to provide either brush contact or wheel contact with the underlying surface, permitting optional cleaning positions.

3. The cleaning device of claim 2, wherein said front plate may be secured in either of said positions by locking means located on side portions of said front and rear plates.

4. The cleaning device of claim 1, further consisting of turned down edge portions on said rear plate, extending down vertically from the side portions of said rear plate, maintaining a minimal clearance from the underlying surface, thereby minimizing the suction from the side and rear edges of the device and maximizing the suction at the front of the device, whereby the effectiveness of the device is maximized.

* * * * *